United States Patent [19]

Mayo et al.

[11] 4,436,330

[45] Mar. 13, 1984

[54] FOLDING SUPPORT WITH DOUBLE-POSITIVE LOCK

[75] Inventors: Henry C. Mayo, Alexandria; Joseph E. Korzendorfer, Manassas, both of Va.

[73] Assignee: The United States of America as represented by the Secretary of the Army, Washington, D.C.

[21] Appl. No.: 327,530

[22] Filed: Dec. 4, 1981

[51] Int. Cl.[3] ..... E05C 17/32

[52] U.S. Cl. ..... 292/263

[58] Field of Search ..... 292/263, 152, 209, 107

[56] References Cited

U.S. PATENT DOCUMENTS

| | | | |
|---|---|---|---|
| 609,214 | 8/1898 | Shaw | 292/263 |
| 1,241,099 | 9/1917 | Drake | 292/263 |
| 1,306,929 | 6/1919 | Sipes | 292/263 |
| 1,654,995 | 1/1928 | Purvis | 292/263 X |
| 2,212,977 | 8/1940 | De Boer et al. | 292/263 X |

*Primary Examiner*—Richard E. Moore

*Attorney, Agent, or Firm*—Robert P. Gibson; Anthony T. Lane

[57] ABSTRACT

A support mechanism wherein two rods or bars are pivotally connected to permit folding. A slot is provided in one bar at the pivot pin and a spring latch is provided in the other bar near the pivot pin. The bars are attached at the extreme ends to other items. When fully extended, this mechanism can support an item such as a heavy hood in a double-positive fashion by automatic simultaneous engagement of both locking devices. The mechanism can also be stored in minimum space by releasing the locks and folding.

9 Claims, 5 Drawing Figures

FIG.1
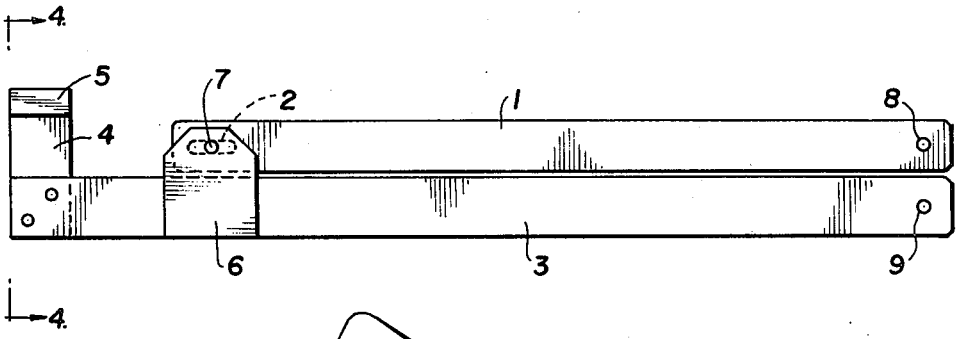
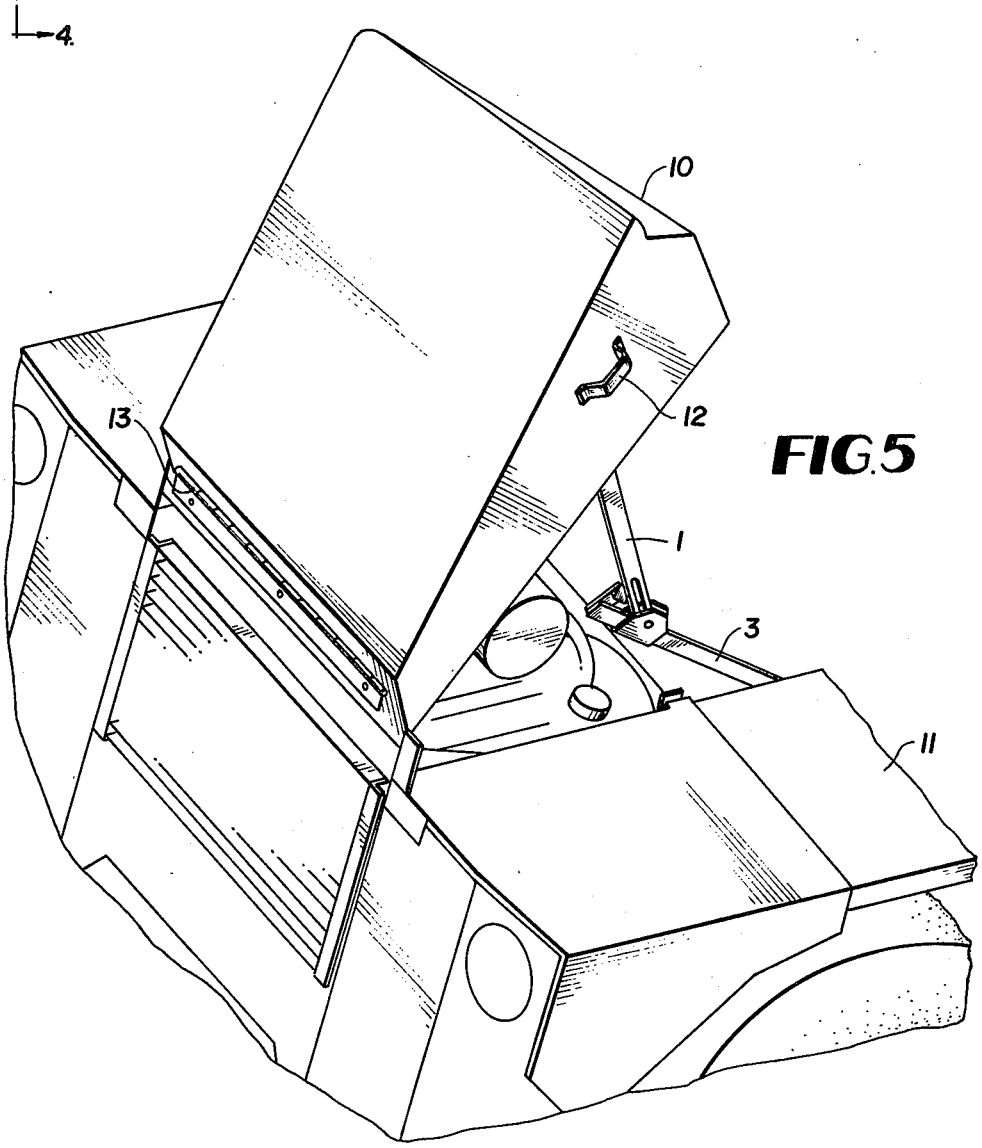
FIG.5

FIG.2
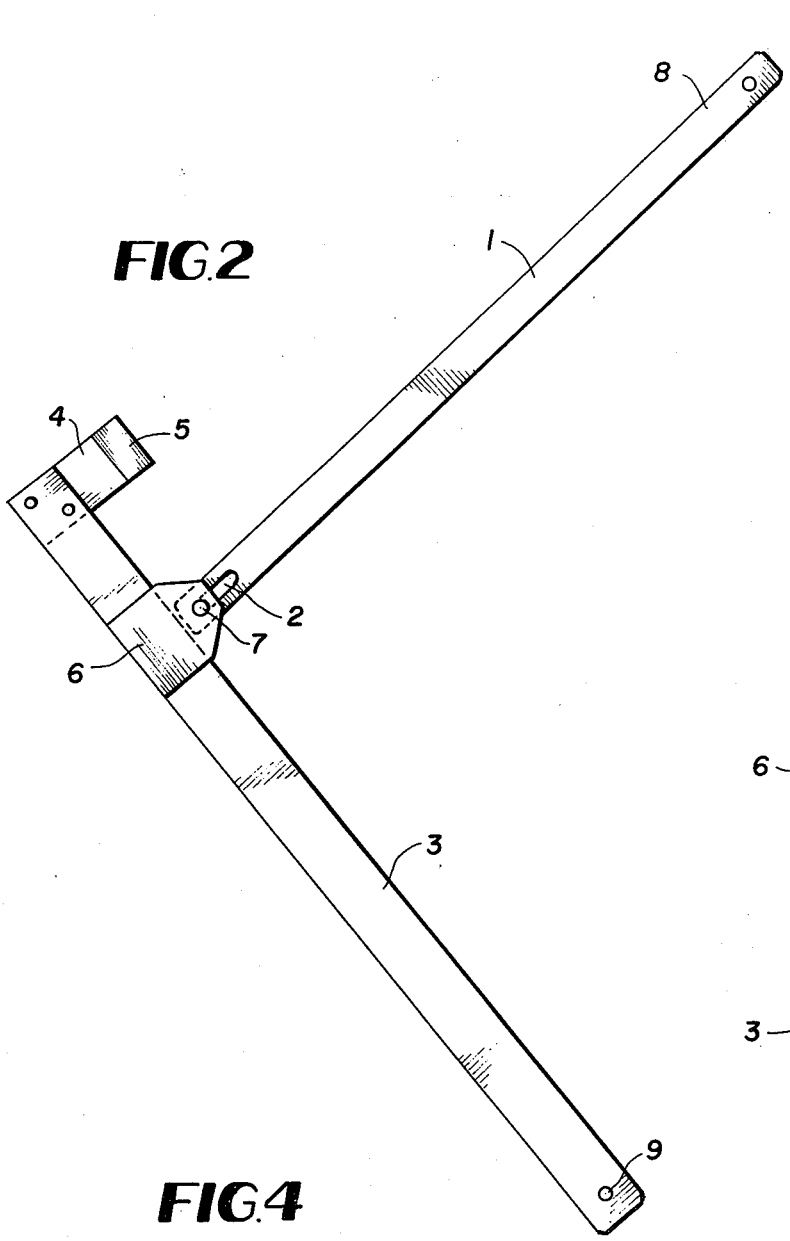
FIG.4
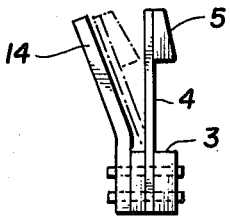
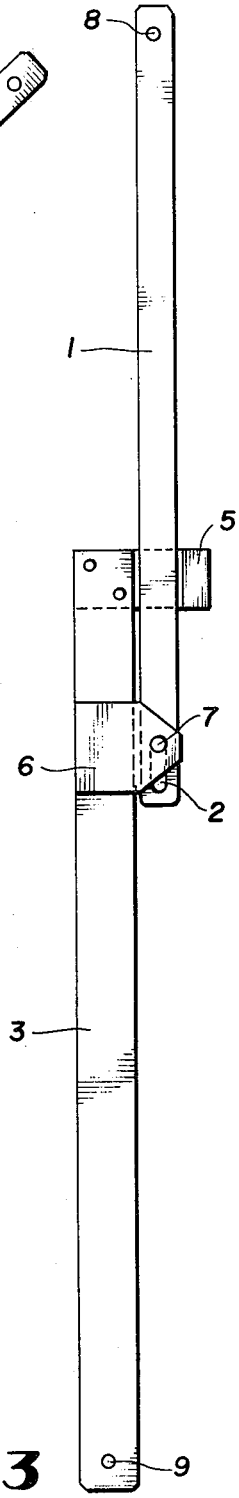
FIG.3

FOLDING SUPPORT WITH DOUBLE-POSITIVE LOCK

BACKGROUND OF THE INVENTION

The invention relates to a temporary support for heavy engine covers or hoods for large off-road vehicles. The invention further relates to other vehicles or structures which require an easily operated and safe temporary support. In particular, the invention relates to supports having folding features and double-positive locks.

Heretofore, folding hood supports have made use of a single locking arrangement. This arrangement includes over-center devices; ratchet released by raising hood from supported position and spring latch devices. Such supports are at a disadvantage for safe, long-term use on heavy hoods in outdoor environments for several reasons. Wear during use makes the spring actuated latches unreliable and unsafe since failure could cause the heavy hood to fall on maintenance personnel. Wind induced loads could cause over-center or ratchet hoods to inadvertently release, resulting in an unsafe situation. A hood support utilizing two independent, positive latches is essential for safety to personnel working beneath heavy, temporarily supported hoods and, due to the above-noted inadequacies of the prior art, this need has gone unfulfilled until the present invention.

OBJECTS AND SUMMARY OF THE INVENTION

It is an object of this invention to provide a folding support construction which incorporates two independently operating locking mechanisms permitting double-positive locking of the support in the fully extended position and easy compact storage in the folded position.

Another object of this invention is to provide a folding support construction in which two rods are pivotally connected with one rod having a spring-type latch and the other rod having a slot at the pivot which acts as a second lock when exposed in the extended position to the weight of the supported item.

Still another object of the invention is to provide a support suitable for propping vehicle hoods or other covers, support of temporary shelving or table tops which are hinged and are stored parallel to a wall or bulkhead, and for use in supporting covers or temporary shelters such as awnings during periods of use.

A further object of the invention is to provide a folding support construction which is reliable and safe for holding heavy hoods or covers in the raised position without concern as to whether long-term usage or abuse could cause a single locking mechanism to fail.

This invention is directed toward a folding support rod or bar construction wherein two rods are pivotally connected to each other. One rod is slotted at the pivot to provide a positive lock when the rods are extended in the support position. The other rod is fitted with a spring actuated latch near the pivot to provide a second positive lock in the extended position. The extreme ends of the rod assembly are provided with holes or other means of mounting the rod to the vehicle hood or chassis. When not in use, the support is folded in a stored position beneath a vehicle hood. In operation, the hood is initially raised, thereby unfolding and extending the support. When the hood is fully raised, the spring latch actuates to keep the support in the extended position and keep the vehicle hood in the raised position. As the weight of the hood is allowed to settle on the extended support, the slotted lock is engaged—thereby effecting a double-positive lock for the support of the hood.

The above, and still further objects, novel features, and advantages of the present invention will become apparent upon consideration of the following detailed description of one specific embodiment thereof, especially when considered in conjunction with the accompanying drawings.

BRIEF DESCRIPTION OF THE DRAWINGS

FIG. 1 is a side view of the hood support in the folded (stored) position;

FIG. 2 is a side view of the support in the intermediate position;

FIG. 3 is a side view of the support in the extended and locked position;

FIG. 4 is an end view of the spring actuated latch; and

FIG. 5 is an isometric view of the folding support attached to a vehicle hood, with the hood shown in the initial partially raised position.

DESCRIPTION OF THE PREFERRED EMBODIMENT

Referring to the drawings in detail, there is illustrated a folding support with independent locking means which includes a rod 1 with a slot 2, and a second rod 3 with a plate spring 4 and a catch 5. The rod 3 is fitted with a bracket assembly 6 which is used to pivotally attach rod 1 to rod 3 by means of pin 7. The pin 7 is rigidly attached to the bracket 6 and the bracket 6 is rigidly attached to rod 3. Holes 8 and 9 are located at the free ends of the rods 1 and 3, respectively, to serve as a suitable attachment means to other structures such as hood 10 and body 11. The rods are free to pivot about pin 7 in either clockwise or counterclockwise direction during operation of the folding feature until the respective folded or locked positions are assumed.

For storage, the rods are free to pivotally rotate in opposite directions until rod 1 contacts rod 3 as shown in FIG. 1.

For locking in the extended or prop position, the rods are free to pivotally rotate in opposite directions 180 degrees from the storage position with rod 1 passing by catch 5 until rods 1 and 2 are extended parallel and catch 5 is engaged. Engagement of the catch prevents further rotation of the rods in either direction. The catch may be disengaged by application of external force at the catch 5 to deflect the spring 4 and move the catch free of contact with rod 1.

In this fully extended position, rods 1 and 2 are free to slide relative to one another within the confines of the slot 2. Relative sliding of the rods in the direction which causes holes 8 and 9 to move closer together places pin 7 in the slot location closest to hole 8. In this position, contact of the slotted end of rod 1 with rod 3 or contact of rod 1 with rod 3 at the catch end prevents relative rotation of the rods in either direction. Relative sliding of the rods in the direction which moves eyes 8 and 9 further apart places pin 7 in the slot location furthest from eye 8 and permits free relative motion of the rods once again.

OPERATION OF AN EMBODIMENT OF THIS INVENTION

For operation, the folding support is typically attached to a vehicle hood 10 and body 11 by means of bolts or pins through the holes 8 and 9, as illustrated in FIG. 5. The installation permits rod 1 to pivotally rotate about the bolt through hole 8, and permits rod 3 to pivotally rotate about the bolt through hole 9. When the hood is closed, the support is folded with rods 1 and 3 in a substantially horizontal position as shown in FIG. 1. When the hood is open for access, rods 1 and 3 are extended in a substantially vertical position as pictured in FIG. 3.

When access beneath the closed vehicle hood is required, the hood is lifted as by handle 12 and pivots about hinge 13. Simultaneously with the lifting of the hood, the rod 1 and rod 3 are pivotally rotated in opposite directions about pin 7 to extend the hood support assembly. As lifting of the hood continues, the rods 1 and 3 become increasingly more extended, until rod 1 engages catch 5. Further lifting of the hood causes rod 1 to press against catch 5, deflecting spring 4 until rod 1 passes by and is secured by catch 5. In this fully extended position, rods 1 and 2 have rotated 180 degrees relative to each other and have assured a parallel and essentially vertical position. When the rods 1 and 3 are fully extended, the position of the pin 7 within slot 2 is at the opposite end of the slot from hole 8. The hood 10 is locked in the propped position by actuation of catch assembly 4 and 5.

When lifting of the hood is stopped, the weight of the hood produces a downward bearing load on the extended hood support. This load causes rod 1 to slide downward relative to rod 3 until stopped by pin 7 contacting the end of slot 2 closest to hole 8. In this position, rod 1 is prevented from pivoted rotation about pin 7 with respect to rod 3 by contact of the lower (slotted) end of rod 1 with rod 3 or by contact of the upper (catch) end of rod 3 with rod 1. Rods 1 and 3 are thus locked in place by means of the slot position.

When both the catch and the slot locking modes are engaged, the hood support is securely restrained in extended propped position by double-positive locks.

The hood may be returned to its horizontal stored position by releasing the double-positive lock by means of manual intervention. The hood is lifted upward for a short distance to cause rod 1 to slide relative to rod 3 until the lower end of the slot 2 encounters pin 7. While the hood lifting force remains applied, the catch 5 is pushed by hand or foot to deflect spring 4 and release catch 5. Spring stop 14 is provided to prevent spring 4 from being manipulated past its point of elasticity. A similar pushing action on catch 5 is applied to rotate rod 3 opposite to rod 1, bringing rod 1 out of the grasp of the catch 5. Upward pressure lifting the hood is simultaneously reduced to permit the hood 10 to start downward rotation about hinge 13. In the process, the folding support starts to fold into storage position. When the hood 10 makes full contact with the body 11, the hood completely closes in an essentially horizontal position and the folding support has returned to the essentially horizontal, folded and stored position.

As is now readily apparent, we have provided a folding hood support with independent locks for the prop position that give the advantages of simple construction, easy manual operation, and double-positive locking. The increase in ease, reliability and safety for folding hood supports thereby fulfills a long recognized need.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A folding support assembly which opens to hold a supported object a predetermined distance from a supporting object having a first arm with a slot at one end, a second arm having a first end and a second end, said first end being pivotally connected to one of said supporting object and said supported object, and having a bracket assembly extending from the second arm mounted along the length of the second arm between the first and second ends of the second arm, a pin mounted in the bracket assembly, wherein the first arm is connected to the second arm at the bracket assembly such that the pin of the second arm extends through the slot of the first arm and the first arm is pivotable about the pin, and further having:

a latch assembly positioned on the second arm on said second end which locks the pivotable movement of the first arm when the support assembly is in an open position.

2. A support assembly as defined in claim 1, wherein the catch assembly includes:

a plate spring secured to one end of the second arm;

a catch mounted on the plate spring.

3. A support assembly as defined in claim 1, wherein the slot, the first arm and the second arm are dimensioned such that when the pin is positioned at one end of the slot, pivoting of the first arm with respect to the pin is permitted and when the pin is positioned at the opposite end of the slot, pivoting of the first arm with respect to the pin is prevented.

4. A support assembly as defined in claim 2, wherein the slot, the first arm and the second arm are dimensioned such that when the pin is positioned at one end of the slot, pivoting of the first arm with respect to the pin is permitted and when the pin is positioned at the opposite end of the slot, pivoting of the first arm with respect to the pin is prevented.

5. A support assembly as defined in claim 4, further having a spring stop mounted on one end of the second arm such that the spring stop limits the motion of the plate spring.

6. A folding support assembly which opens to hold a supported object a predetermined distance from a supporting object including:

a first arm having a first end connected to the supported object and a second end which is slotted;

a second arm having a first end connected to the supporting object;

a catch assembly secured on the second end of the second arm;

a bracket assembly mounted along the length of the second arm between the first and second ends of the second arm;

a pin carried by the bracket assembly; wherein the pin of the second arm extends through the the slot of the first arm such that the first arm is connected to the second arm at the bracket assembly and such that the first arm is pivotable about the pin, and further wherein the catch assembly is mounted to lock the pivotable movement of the first arm when the support assembly is in the open position.

7. A support assembly as defined in claim 6, wherein the slot, the first arm and the second arm are dimensioned such that when the pin is positioned at one end of the slot, pivoting of the first arm with respect to the pin is permitted and when the pin is positioned at the opposite end of the slot, pivoting of the first arm with respect to the pin is prevented.

8. A support assembly as defined in claim 7, wherein the catch assembly includes:

a plate spring secured to the second end of the second arm;

a catch mounted on the plate spring.

9. A support assembly as defined in claim 8, further having a spring stop mounted on the second end of the second arm such that the spring stop limits the motion of the plate spring.

* * * * *